US007083167B2

(12) United States Patent
Barthold

(10) Patent No.: US 7,083,167 B2
(45) Date of Patent: Aug. 1, 2006

(54) METHOD AND DEVICE FOR ALIGNMENT OF INDIVIDUALLY MOVED SHEET-SHAPED MATERIALS

(75) Inventor: Ulrich Barthold, Hohengehren (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 188 days.

(21) Appl. No.: 10/785,212

(22) Filed: Feb. 24, 2004

(65) Prior Publication Data

US 2005/0027390 A1 Feb. 3, 2005

(30) Foreign Application Priority Data

Feb. 24, 2003 (DE) ..... 103 07 715

(51) Int. Cl.
*B65H 7/02* (2006.01)

(52) U.S. Cl. ..... 271/228
(58) Field of Classification Search ..... 271/228
See application file for complete search history.

(56) References Cited

U.S. PATENT DOCUMENTS 4,971,304 A 11/1990 Lofthus
5,094,442 A * 3/1992 Kamprath et al. ..... 271/227
5,169,140 A * 12/1992 Wenthe, Jr. ..... 271/228
5,697,609 A 12/1997 Williams et al.
5,732,943 A 3/1998 Delfosse
5,848,344 A * 12/1998 Milillo et al. ..... 399/395
5,931,462 A 8/1999 Delfosse
6,059,285 A * 5/2000 Suga et al. ..... 271/228
6,647,884 B1 11/2003 La Vos et al.

FOREIGN PATENT DOCUMENTS

EP 0 814 040 A1 12/1997
EP 0 814 041 A2 12/1997
EP 1 110 888 A1 6/2001

OTHER PUBLICATIONS

DE Search Report 103 07 715.4.

* cited by examiner

*Primary Examiner*—Donald P. Walsh
*Assistant Examiner*—Kenneth W. Bower
(74) *Attorney, Agent, or Firm*—Laurence A. Greenberg; Werner H. Stemer; Ralph E. Locher

(57) ABSTRACT

The invention relates to a method for alignment of individually moved sheet-shaped materials with two individually controlled frictional wheels (A, B), wherein the frictional wheels (A, B) carry out speed changes continuously during the entire process of the alignment according to a control function and in this way achieve a change from the state parameters input angle ($\phi_{in}$) and input speed ($v_{in}$) of the sheet-shaped material, to the state parameters output angle ($\phi_{out}$), output speed ($v_{out}$), X shift ($x_{shift}$) and Y shift ($Y_{shift}$).

15 Claims, 6 Drawing Sheets

METHOD AND DEVICE FOR ALIGNMENT OF INDIVIDUALLY MOVED SHEET-SHAPED MATERIALS

FIELD OF THE INVENTION

The invention relates to a method for alignment of individually moved sheet-shaped materials.

BACKGROUND

It is generally necessary to align sheet-shaped materials which have been delivered, to a precise position for a subsequent processing step, such as printing, cutting, punching, binding or the like, since the exact position of the sheet-shaped materials deviates from the specified position as the sheet-shaped material runs through the processing device, e.g. a printing machine, a digital printer or copier.

An alignment may be necessary if the existing alignment of the sheet-shaped materials will be changed, such as when a sheet-shaped material that is aligned with an edge will be aligned with a center line or if the orientation will be changed from portrait format to landscape format or vice versa. In the prior art, there are a number of different methods and devices used to achieve an alignment of this type. One group of these devices uses two frictional wheels having the same axis and operated independently of each other with stepper motors. If these two frictional wheels are brought into contact with the sheet-shaped material, the sheet-shaped material experiences a rotary movement if the frictional wheels are operated with angular velocities that are different from each other.

In EP 814 040 B1, in a first phase, a sheet is first turned by an angle in one direction by two frictional wheels then in a second phase it is transported forward, whereby the two frictional wheels move uniformly, and then is turned in reverse in a third phase. During the rotary movements, the angular velocity of one frictional wheel is essentially increased by the amount by which the angular velocity of the other frictional wheel is reduced. After a brief angular velocity change, the rotation process is carried out with two constant angular velocities, after which the angular velocities of the two frictional wheels are adapted again to the transport speed in forward direction. Skewing of a sheet can be compensated, in that the duration of rotation in one direction is selected so that it is different from the duration of rotation in the other direction. A lateral shift is achieved here, since the pivot point of rotation of the first phase is different from the pivot point of rotation of the second phase. A disadvantage here is that a relatively large amount of space is required to achieve the lateral shift by deriving it from a forward movement.

In a related patent EP 0 814 041 B1, a similar method is used in order to cause a change in the orientation of the sheets from a portrait orientation to a landscape orientation, i.e. to rotate the sheet essentially by 90° and at the same time compensate any lateral misalignment or skewed position of the sheets that may exist. Lateral misalignment and skewed position are compensated here by the selection of the suitable pivot point and duration of rotation.

DETAILED DESCRIPTION

Figure 1:
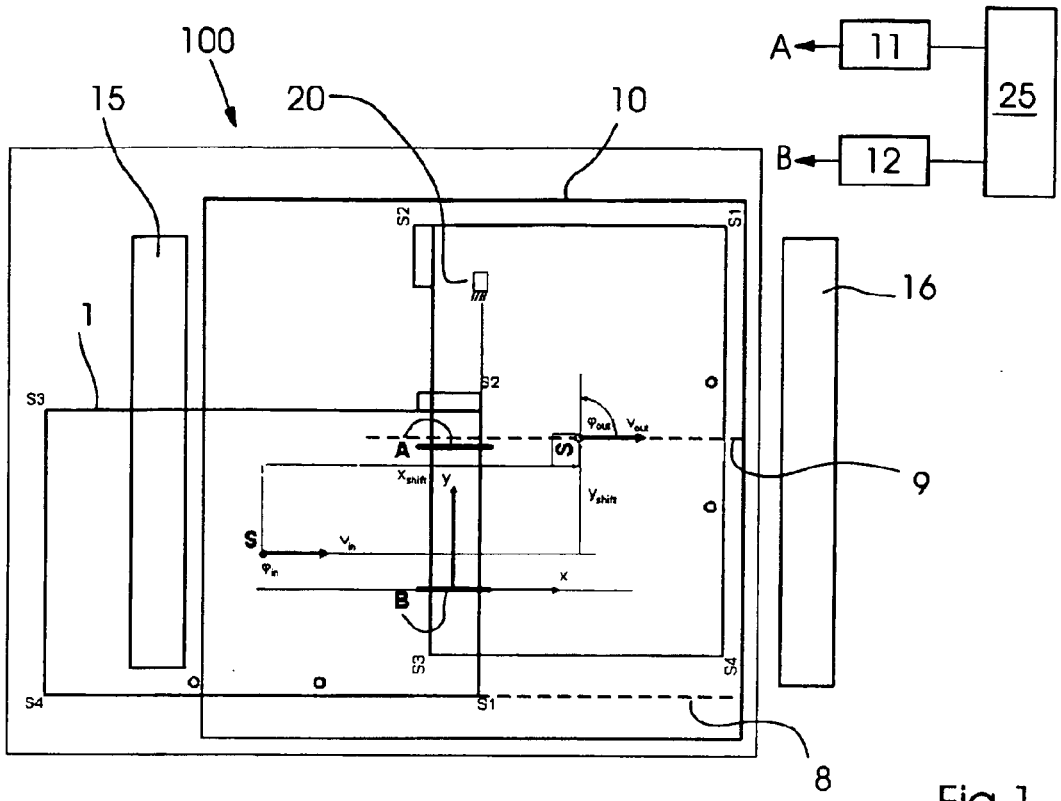
FIG. 1 is a schematic view of the overall structure of the device according to the invention.

FIG. 1 shows the overall structure of a device 100 for carrying out the method according to the invention. Other drive, control and/or guide means and cam wheels that are generally known and necessary for operation of the device are only shown schematically and/or will only be described in a general way. In FIG. 1, the frictional wheels are shown with the same axis, however that need not necessarily be the case since with corresponding control functions the frictional wheels A, B can also have two parallel axes. Advantageously, the axes of frictional wheels A, B are perpendicular to the direction of the input speed $v_{in}$.

A sheet-shaped material 1 with the corners S1, S2, S3, S4 is brought into contact with the first frictional wheel A and the second frictional wheel B by a first transport unit 15 at an input speed $v_{in}$ and an input angle $\phi_{in}$, indicated in FIG. 1 with an arrow. The input angle $\phi_{in}$ indicates the angle between the input speed $v_{in}$ that corresponds to the X-axis, and the direction of an edge from the corner S2 to S3 and/or S1 to S4. A sensor 20 records the front edge of the sheet-shaped material 1. After that, the first drive 11 of the first frictional wheel A and/or the second drive 12 of the second frictional wheel B is actuated by a controller 25 according to a suitable control function. Additional sensors may be provided that measure the input angle $\phi_{in}$ and the input speed $v_{in}$ prior to this. The input speed can be derived, for example, from the transport speed of the first transport unit 15.

According to the control functions for the drives 11, 12, the frictional wheels A, B rotate and shift the sheet-shaped material 1 so that the sheet-shaped material 1 is provided with an output angle $v_{out}$ and a movement in X direction $x_{shift}$ and a movement in Y direction $y_{shift}$ and transferred to a second transport unit 16. In addition, the input speed $v_{in}$ can be changed to an output speed $v_{out}$ by the rollers A and B according to the control function for the drives 11, 12. In the case shown in FIG. 1, with the use of corresponding control functions for the drives 11, 12, a laterally aligned sheet-shaped material is turned from an alignment with a side line 8, by 90°, to an alignment with a center line 9. In this process, the area that the sheet-shaped material 1 has passed over during this movement is within the area identified with the reference character 10. This area 10 represents the movement area that is available to a sheet-shaped material in the process according to the invention. The movement area 10 is essentially determined by the construction space available. The movement area 10 can be increased by temporary lifting of the first and second transport units 15, 16.

Figure 2A:
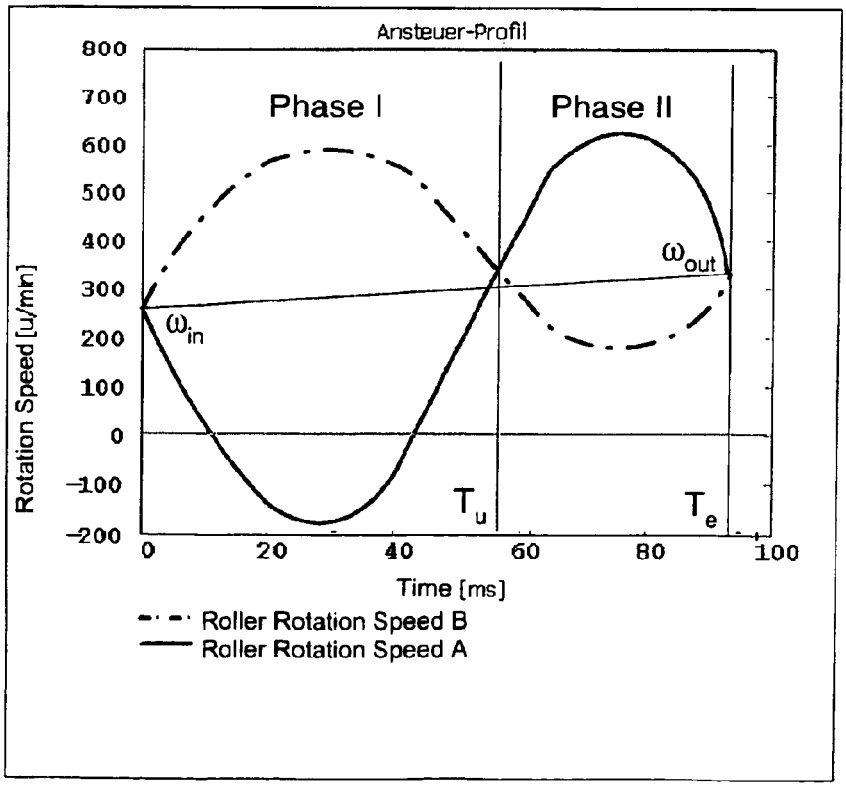
FIG. 2*a* is a general control profile for the two frictional wheels according to the method according to the invention.

FIG. 2*a* shows a general control profile as corresponds to the method according to the invention. In it, the rotation speeds of frictional wheels A and B are entered over time. Frictional wheel A and frictional wheel B both start with the same input angular velocity or rotation speed ωin. In the first phase, the angular velocity of the frictional wheel A increases continuously, the sign changes, then it increases to about 200 rpm opposite the first direction, then it decreases again, the sign changes again, there is a further increase and then in phase 2, it reaches a maximum of approx. 600 rpm and then continuously drops to an output angular velocity $\omega_{out}$. The angular velocity of frictional wheel B at first increases in parallel in order to reach its maximum of about 600 rpm in phase 1, then continuously drops to about 200 rpm at the minimum in phase 2 and then increases again to the common output angular velocity $\omega_{out}$ The input angular velocities ωin and the output angular velocities $\omega_{out}$ can be the same but do not necessarily have to be the same. The transition from phase 1 to phase 2 occurs at time $T_u$, at which the angular velocities of frictional wheels A and B are the same, about 350 rpm, in the case shown. What is important is that in phase 1, one of the frictional wheels turns faster than the other and in phase 2 the same frictional wheel now turns more slowly than the other frictional wheel and that the angular velocity of frictional wheel A and frictional wheel B are continuously changed. As can be seen in FIG. 2*a*, it is also not necessary, at time $T_u$, for the common angular velocity of frictional wheels A and B to correspond to the average angular velocity.

Figure 2B:
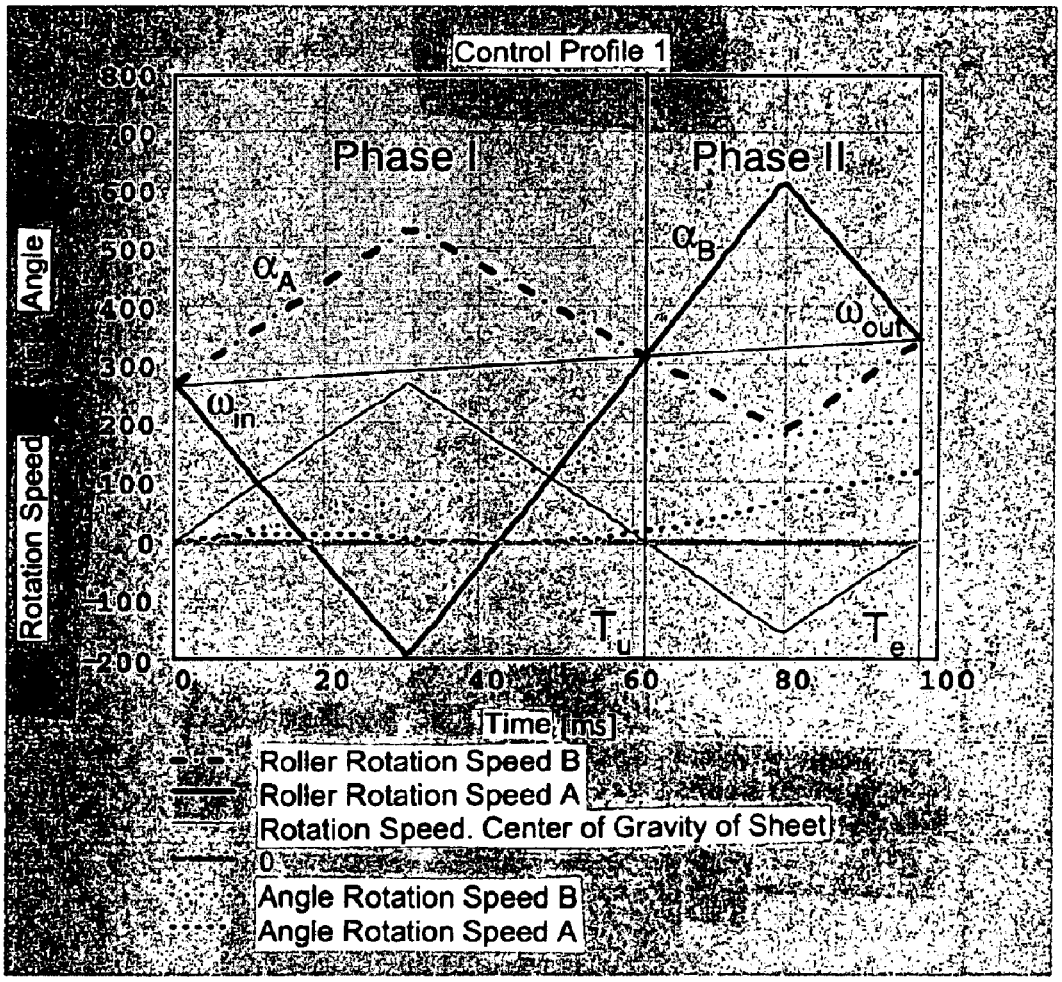
FIG. 2*b* is a general control profile for the two frictional wheels of the method according to the invention with constant change rates of the angular velocity.

FIG. 2*b* shows the function parameters of a preferred embodiment that are relevant for the control functions, using a control profile of the speeds of frictional wheels A and B. The function parameters are the angular acceleration of frictional wheel A $\alpha_A$, the angular acceleration of the frictional wheel B $\alpha_B$, the changeover time $T_u$, at which the change from the first phase to the second phase occurs, the ending time of the alignment process Te, the input rotation speeds $\omega_{in}$ and the output rotation speeds $\omega_{out}$, whereby each of the input rotation speeds $\omega_{in}$ of the two frictional wheels are the same and the output rotational speeds $\omega_{out}$ of the two frictional wheels are also the same, but input rotational speeds $\omega_{in}$ and output rotational speeds $\omega_{out}$ can differ from each other. The angular accelerations $\alpha_A$, $\alpha_B$ of the frictional wheels A, B can be functions with time dependency here. In a preferred embodiment, the angular accelerations $\alpha_A$, $\alpha_B$ of the frictional wheels A, B are each constant the entire time. The change rate of the angular velocities of frictional wheels A, B is constant at least in sections. In addition, the graphs in FIG. 2*b* show the speed of rotation of the center of gravity of the sheet-shaped material and the change in angles of rotation A and B. In this case, at time $T_u$, the angular velocities of the frictional wheels A and B correlate with the average angular velocity.

Figure 3A:
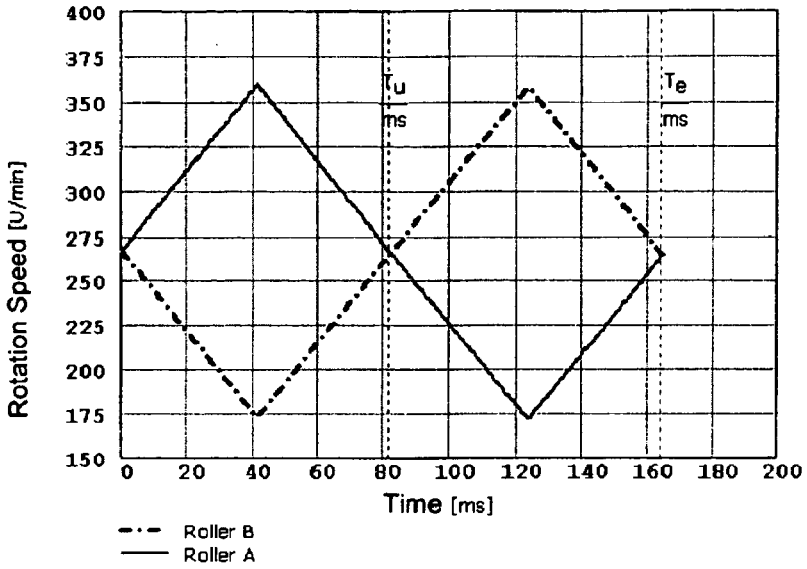
FIG. 3*a* is an example control profile for the lateral shift of the sheet-shaped material.
Figure 3B:
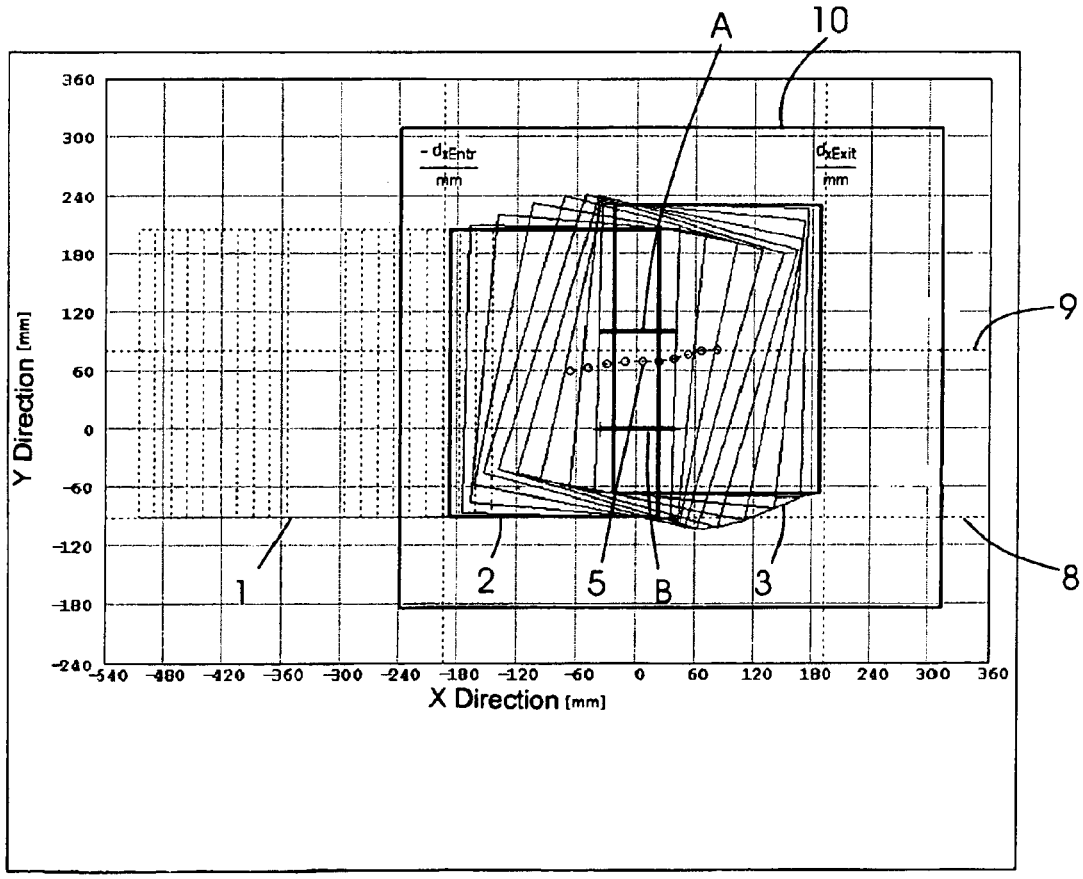
FIG. 3*b* is a schematic view of the alignment procedure of a sheet with a control profile according to FIG. 3*a*.

FIG. 3*a* shows the control functions for the drives 11, 12 of the frictional wheels A, B that cause a lateral shift of a sheet-shaped material. The control functions have mirror symmetry with respect to the average angular velocity of the frictional wheels A and B. As can be seen in FIG. 3*b*, this leads to a back and forth rotation of the sheet-shaped material 1. Since the rotation occurs outside the center of gravity 5, the rotation in the first phase and the subsequent rotation in the reverse rotation direction in the second phase lead to the desired shift. The sheet-shaped material 1, which at the beginning of phase 1 is located in the starting position 2 and is aligned with the side line 8 of the sheet-shaped material 1, is transferred by the control function according to FIG. 3*a* to an ending position 3 aligned along the center line 9.

Figure 4A:
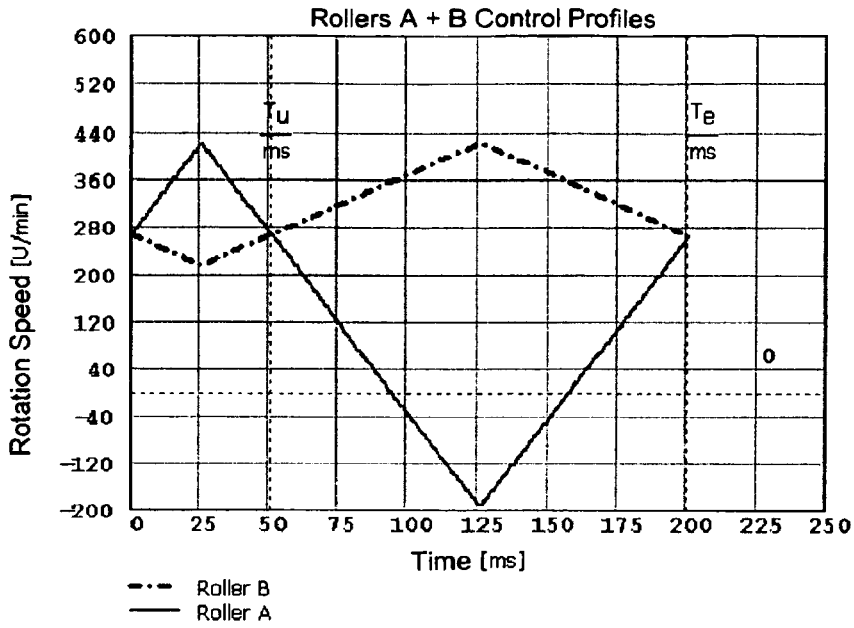
FIG. 4*a* is an example control profile for aligning a sheet-shaped material and rotating it by 90°.

FIG. 4*a* shows the control functions of the drives 11, 12 of the frictional wheels A, B that cause a rotation of a sheet-shaped material 1 by essentially 90°. In this process, the direction of rotation of the drive 11 of the frictional wheel A is sometimes reversed in the second phase. In the first phase, mainly the lateral shift from the position aligned with the side line to the position aligned with the center line 9 occurs.

Figure 4B:
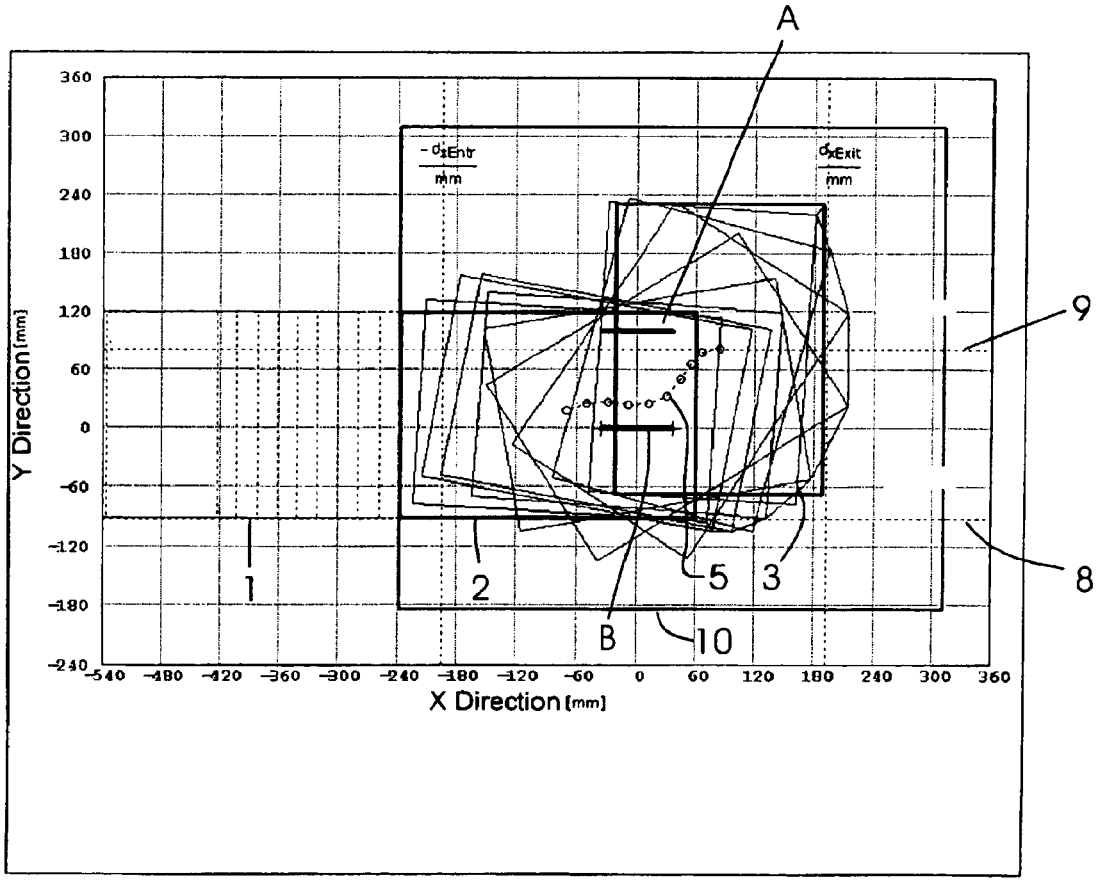
FIG. 4*b* is a schematic view of the alignment process of a sheet with a control profile according to FIG. 4*a*.

FIG. 4*b* shows the alignment procedure of a sheet-shaped material 1 from a starting position 2 to a target position 3 according to the control functions from FIG. 4*a*. Because of the reverse movement of the frictional wheel B in the second phase, a rotation process that is especially space-saving can be achieved.

Figure 5A:
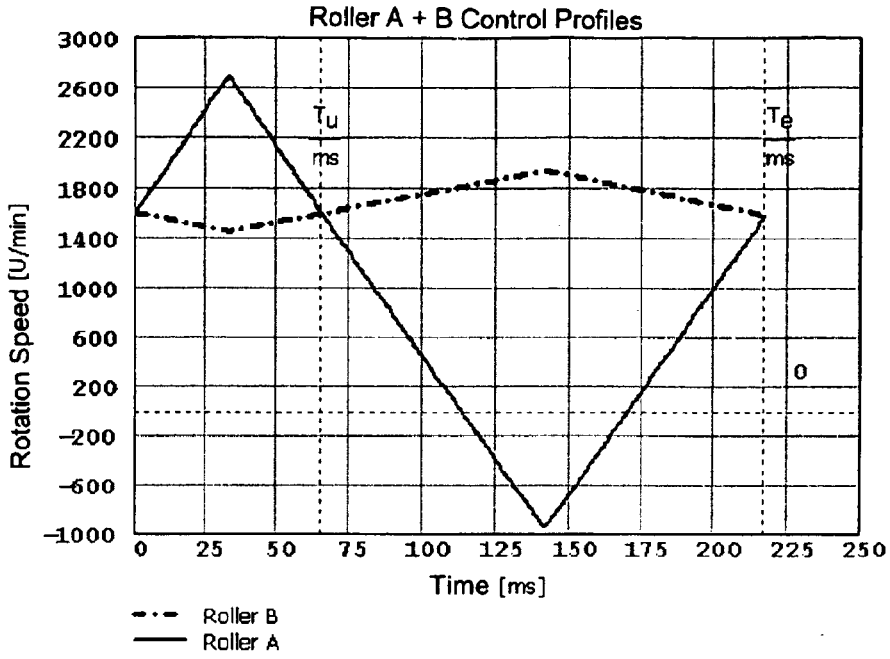
FIG. 5*a* is an example of a control function of the frictional wheels for any optional transfer of the input state parameters to the output state parameters.
Figure 5B:
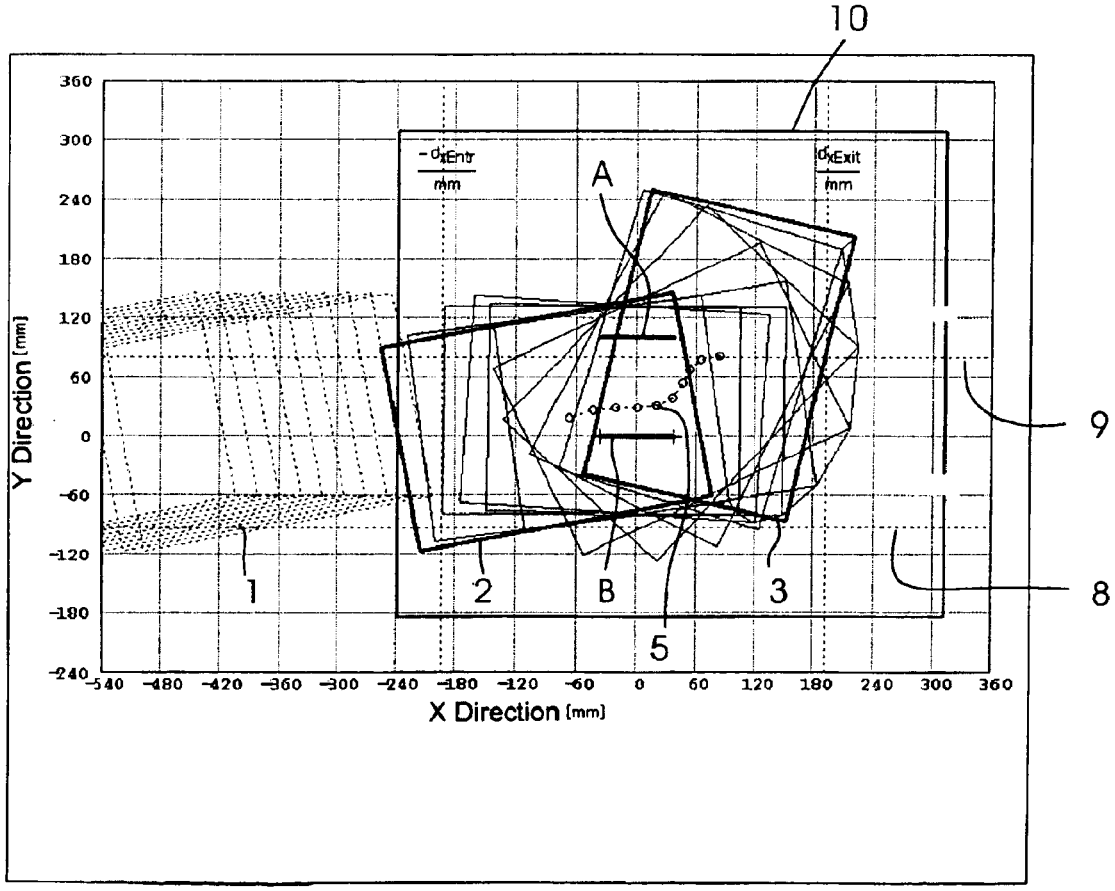
FIG. 5*b* is a schematic view of the alignment process of a sheet with a control profile according to FIG. 5*a*.

FIG. 5*a* shows other control functions for the drives 11, 12 of the frictional wheels A, B. As can be seen in FIG. 5*b*, in this case a sheet-shaped material 1 is transferred from a starting position 2 in which the sheet-shaped material 1 has any input angle $\phi_{in}$ to a target position 3 in which the sheet-shaped material has any output angle $\phi_{in}$, $\phi_{out}$.

Figure 6:
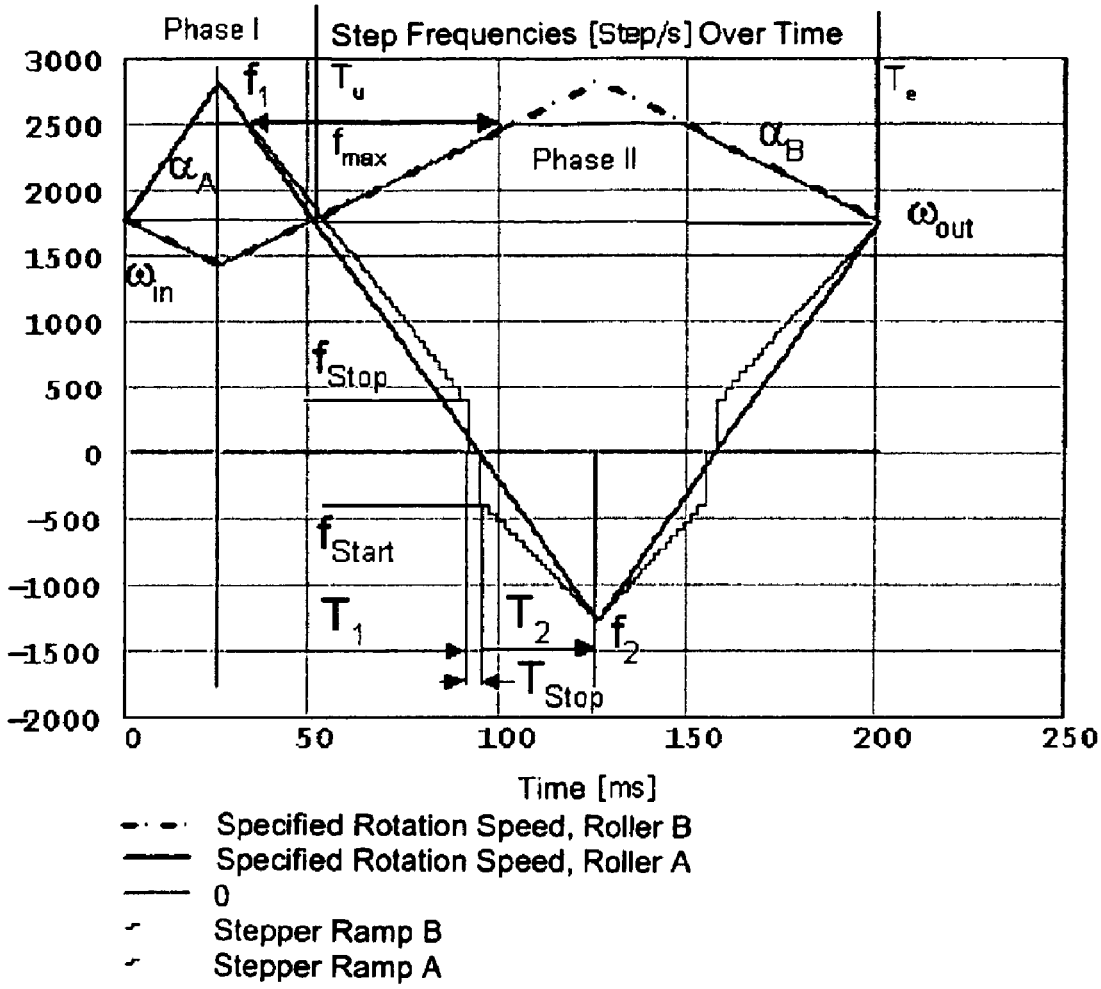
FIG. 6 is a control function with a zero crossing and distorted control functions to accelerate the zero crossing.

FIG. 6 shows special characteristics of the control functions of the drives 11, 12 of the frictional wheels A, B that result from the use of stepper motors as the drives 11, 12. Stepper motors have the characteristic that they can only advance to quantized angular positions. This is problematic, above all during changes in direction of rotation, i.e. a zero crossing of the rotation speed, since in this case a definite jump in rotation speed is necessary. During the jump of one of the frictional wheels A, B to the rotation speed zero and the resulting standstill with simultaneous further transport by the other frictional wheels A, B, scuffing marks can develop on the sheet-shaped material 1. In addition, stepper motors cannot be operated beyond a specific frequency. Accordingly, the control functions are adjusted specially for the zero crossings. The quantization of the steps of the stepper motor is poorer and poorer with decreasing frequency. In addition, there are resonance problems at frequencies below 400 Hertz. Since this would lead to incorrect ending positions of the sheet-shaped material, a distorted stepper motor ramp is generated from the undistorted control function, input into the motion equation of the sheet-shaped material 1, and thereby optimizes function parameters of the undistorted control function. The change range of the angular velocity as shown in the example is decreased to a time $T_1$, whereby time $T_1$ corresponds to the time at which the slowed changed angular velocity of the frictional wheel A has dropped to approximately 400 Hertz. The stepper motor 11 initiates a pause $T_{stop}$. In the second time interval $T_2$, the stepper motor 11 starts with a frequency of −400 Hertz and increases with a change rate, which is also decreased, up to the frequency $F_2$. The process repeats with reversed signs during the second zero crossing. The braking time $T_{stop}$ is selected so it is minimal so that the stepper motor just comes to a stop within it. In addition, when the maximum frequency $F_{max}$ is reached, the original control function is cut off.

Advantageously, the control functions are selected if possible in such a way that when the maximum frequency $F_{max}$ is reached, the drives 11, 12 do not stop.

The present invention is useful in inline further processing of print products, in digital printing machines and especially as an interface between the processing devices made by different manufacturers. However, the present invention is not restricted to this application, and can also be used in connection with the method according to the invention in order to precisely position, for example, envelopes or packages or other objects, e.g. metal or wood pallets. In any case use in all digital printers, copiers or other printing machines in which sheet-shaped materials are individually processed, especially use in the offline further processing of sheet-shaped materials is also within the prevue of the invention.

Individually moved sheet-shaped materials are characterized by the following state parameters: input angle, output angle, input speed, output speed, X shift and Y shift, The present invention changes the state parameters, input angle and input speed, of an individually supplied sheet-shaped material into the state parameters output angle, output speed, X shift and Y shift by:

a) acceptance of the sheet-shaped material from a first transport unit by a first frictional wheel and a second frictional wheel, whereby the first and second frictional wheel each have independent individual drives,
b) continuous rotation of the sheet-shaped material in a first phase in a first direction of rotation using control functions for the angular velocities of the first frictional wheel and of the second frictional wheel, whereby at the beginning and end of the first phase the angular velocities of the first and second frictional wheels are the same,
c) continuous rotation of the sheet-shaped material in a second phase in a second direction of rotation opposing the first one, using a control function for the angular velocities of the first frictional wheel and of the second frictional wheel, whereby at the beginning and end of the second phase the angular velocities of the first and second frictional wheels are the same, and
d) delivery of the aligned sheet-shaped material to a second transport unit.

Accordingly, it is a matter of a flowing rotational movement of the sheet-shaped material composed of two phases with different rotation directions, in which the sheet-shaped material continuously changes its angular position. In this way, in a practical physical framework, sheet-shaped materials can be brought from any input states (position and speed) into any output states (position and speed) within an alignment process. In particular, the possibility of a change in the intake speed is therefore also provided.

In an advantageous design of the method according to the invention, the method additionally comprises the step of determining the control function for control of the drives of the frictional wheels from the state parameters input angle, output angle, intake speed, output speed, X shift and Y shift. These six state parameters of the sheet-shaped material are used with a control function in order to fulfill the requirements named with minimum effort. The control functions of the two frictional wheels are optimized in this process with numerical methods, using motion equations of the sheet. To do this, six function parameters are selected, in which the six state parameters are simulated. The six function parameters are the angular acceleration $\alpha_A$ of frictional wheel A, the angular acceleration $\alpha_B$ of frictional wheel B ,the changeover time $T_u$, at which the change from the first phase to the second phase occurs, the end time of the alignment process $T_e$, the input rotation speeds $\omega_{in}$ and the output rotation speeds $\omega_{out}$, whereby in each case the input rotation speeds of the two frictional wheels are the same and the output rotation speeds of the two frictional wheels are also the same, but input rotation speeds and output rotation speeds can differ from each other. The angular accelerations $\alpha_A$, $\alpha_B$ of frictional wheels A, B can be functions with time dependency.

The determination of the control function may be carried out for each individual sheet-shaped material. This ensures an optimum adaptation to the individual inherent state of each sheet-shaped material. Alternatively, a fixed, specified control function could be determined for a larger number of sheet-shaped materials, say for a complete set of sheet-shaped materials. This would make sense if the inherent states of all sheet-shaped materials in one set are essentially the same before and after alignment. This may be the case, for example, when sheet-shaped materials with side register will be center registered and all side registered sheet-shaped materials have the same inherent states. In this way, the computing effort required for determination can be reduced. However, in practice deviations from the ideal position, for example skewing, often occur, even in one set of the same sheet-shaped materials that are drawn sequentially from a stack or have already run through various processing stations. Therefore in this case, it may be necessary to change the skewing and possibly the lateral shift for each separate sheet-shaped material individually, which requires determination of corresponding control functions for the two frictional wheels.

The control function may be determined using a lookup table. In this way, the required computing effort for determining the control function can advantageously be reduced. The size of the lookup table can be optimized by suitable selection of the parameter ranges.

In the step for determining the control function, the position of the center of gravity of the sheet-shaped material may be taken into consideration in such a way that the control function minimizes the torques that occur. This minimizing of the torques relates to both the torques that act on the sheet-shaped material and to the torques that occur in the frictional wheels. In this way, both the sheet-shaped material and the frictional wheels and their drives are protected.

During the step for determining the control function, the state parameters input angle, output angle, input speed, output speed, X shift and Y shift of the sheet-shaped material are taken into consideration in such a way that the control function minimizes the rotation area needed for the sheet-shaped material. Because of this, the space that may be required by a device for carrying out the method according to the invention may be reduced. This may be especially advantageous if the alignment method is used to accept and align sheet-shaped materials from upstream assemblies, e.g. from processing devices made by different manufacturers. Generally, the rotation area needed is minimum if the center of gravity of the sheet-shaped material does not change or barely changes during the alignment process. With a lateral shift, the position of the center of gravity naturally always changes.

A limited number of control functions may be stored in the form of interpolation points, from which a control selects or interpolates the special control functions using numerical methods. This may be a case of a linear interpolation between the interpolation points. Because of this and with relatively little computing effort, a relationship of the state parameters can be described as a function of a relevant format dimension in a format area of the sheet-shaped material that may be to be covered. The relevant format dimension applies to the width of the sheet-shaped material during a lateral shift and/or the length of the sheet-shaped material when it is rotated. The data required for the control to operate the drives of the frictional wheels depend directly on the state parameters and can thus be expressed in a simple way as a function of the format dimension. If the format area of the sheet-shaped materials that are to be aligned may be divided into suitable smaller format areas, the interpolation points can ultimately be used to determine the optimum control functions for the drives of the frictional wheels in real time for any format of the sheet-shaped materials.

The present invention may also involve another measurement step, in which at least one of the following state parameters is determined: input angle, input speed, X shift and Y shift. In this way, it is possible to achieve a recording of the current inherent state of the sheet-shaped material immediately before the alignment, and the optimum drive functions for the drives of the frictional wheels can be determined accordingly.

The control functions of the first and/or second drive of the frictional wheels may be selected in such a way that the change rates $\alpha_A$, $\alpha_B$ of the angular velocities remain constant for each frictional wheel during the process. In this way, parameters can be set better for the control functions.

The input angle and the output angle may essentially differ by 90°. This means that in addition to correction of any skewing that may be present, a change in the orientation of the sheet-shaped material is carried out, for example from portrait format to landscape format.

One of the frictional wheels may carry out a change in direction during at least one of the rotation steps. In this way, among other things, the fact that the sheet-shaped material is especially quickly rotated is achieved and in this process the smallest possible area is needed.

If at least one of the frictional wheels carries out a change in direction, the angular velocity of the frictional wheel involved may be distorted in the zero crossing in such a way that the zero crossing occurs as quickly as possible. In this context, zero crossing should be understood to mean that the angular speed of the frictional wheel is zero, i.e. the frictional wheel stops for an instant. The resulting stoppage of the sheet-shaped material, with simultaneous further transport by the other frictional wheel, can cause scuffing marks on the sheet-shaped material. The control function may be selected in such a way that ultimately no erroneous ending position of the sheet-shaped material occurs because of this.

What is claimed is:

1. A method for aligning individually moved sheet-shaped materials comprising the steps of:

a) accepting the sheet-shaped material from a first transport unit using a first frictional wheel (A) and a second frictional wheel (B), wherein the first and second frictional wheels (A, B) are independently driven;

b) rotating the sheet-shaped material in a first phase in a first direction of rotation by controlling the angular velocities of the first frictional wheel (A) and of the second frictional wheel (B), wherein at the beginning and end of the first phase the angular velocities of the first and second frictional wheels (A, B) are about the same;

c) rotating the sheet-shaped material in a second phase in a second direction of rotation opposing the first one by controlling the angular velocities of the first frictional wheel (A) and of the second frictional wheel (B), wherein at the beginning and end of the second phase the angular velocities of the first and second frictional wheels are about the same;

d) delivering the aligned sheet-shaped material to a second transport unit.

2. A method according to claim 1 further comprising the step of controlling the first and second frictional wheels as a function of one or more state parameters input angle($\phi_{in}$), output angle($\phi_{out}$), input speed($v_{in}$), output speed($v_{out}$), X shift ($x_{shift}t$) and Y shift ($y_{shift}$) of the sheet-shaped materials.

3. A method according to claim 2, wherein the step of controlling the first and second frictional wheels is carried out for each individual sheet-shaped material.

4. A method according to claim 2, wherein the step of controlling the first and second frictional wheels is carried out using a look-up table.

5. A method according to claim 1 further comprising the step of controlling the first and second frictional wheels as a function of the center of gravity of the sheet-shaped material.

6. A method according to claim 2, wherein the input angle ($\phi$in) and the output angle ($\phi$out) differ by about 90°.

7. A method according to claim 1, wherein at least one of the frictional wheels (A, B) changes direction.

8. An apparatus for aligning individually moving sheet-shaped materials between an input transport device and an output transport device comprising:

a first frictional wheel (A) and a second frictional wheel (B) for accepting the sheet-shaped material from the input transport device;

drivers for driving the first frictional wheel (A) and a second frictional wheel (B);

a controller for controlling the first and second frictional wheels drivers to: a) rotate the sheet-shaped material in a first phase in a first direction of rotation by controlling the angular velocities of the first frictional wheel (A) and of the second frictional wheel (B), wherein at the beginning and end of the first phase the angular velocities of the first and second frictional wheels (A, B) are about the same; b) rotate the sheet-shaped material in a second phase in a second direction of rotation opposing the first one by controlling the angular velocities of the first frictional wheel (A) and of the second frictional wheel (B), wherein at the beginning and end of the second phase the angular velocities of the first and second frictional wheels are about the same.

9. An apparatus according to claim 8, wherein the first and second frictional wheels are controlled as a function of one or more state parameters input angle($\phi_{in}$), output angle($\phi_{out}$), input speed($v_{in}$), output speed($v_{out}$), X shift ($x_{shift}t$) and Y shift ($y_{shift}$) of the sheet-shaped materials.

10. An apparatus according to claim 9, wherein controlling the first and second frictional wheels is carried out for each individual sheet-shaped material.

11. An apparatus according to claim 9, wherein controlling the first and second frictional wheels is carried out using a look-up table.

12. An apparatus according to claim 8, wherein the first and second frictional wheels are controlled as a function of the center of gravity of the sheet-shaped material.

13. An apparatus according to claim 9, wherein the input angle ($\phi$in) and the output angle ($\phi$out) differ by about 90°.

14. An apparatus according to claim 8, wherein at least one of the frictional wheels (A, B) changes direction.

15. An apparatus according to claim 8, wherein the drivers are stepper motors.

* * * * *